US005128596A

United States Patent [19]

Shimazu et al.

[11] Patent Number: 5,128,596

[45] Date of Patent: Jul. 7, 1992

[54] GASEOUS-DISCHARGE LAMP HAVING REFLECTOR IN INTERIOR THEREOF

[75] Inventors: Yuji Shimazu; Makoto Miyamoto, both of Hamamatsu, Japan

[73] Assignee: Hamamatsu Photonics K.K., Shizuoka, Japan

[21] Appl. No.: 616,040

[22] Filed: Nov. 20, 1990

[30] Foreign Application Priority Data

Nov. 20, 1989 [JP] Japan ..... 1-301784

[51] Int. Cl.[5] ..... H01J 17/36; H01J 5/16; H01J 61/00

[52] U.S. Cl. ..... 315/335; 315/337; 315/339; 315/261; 313/113; 313/567; 313/581

[58] Field of Search ..... 313/113, 567, 581; 315/335, 337, 339, 261

[56] References Cited

U.S. PATENT DOCUMENTS 4,179,037 12/1979 Chan et al. ..... 313/113

4,658,179 4/1987 Roberts ..... 313/113

*Primary Examiner*—Palmer C. DeMeo

*Assistant Examiner*—Nimeshkumar D. Patel

*Attorney, Agent, or Firm*—Sughrue, Mion, Zinn, Macpeak & Seas

[57] ABSTRACT

A gaseous-discharge lamp has a valve defining an interior of the lamp in which an inert gas, such as xenon, is confined. A cup-shaped reflector is disposed in the interior of the lamp, whose inner surface cross-section is preferably a hyperbola or an ellipse so that a collimated light spot is projected outwardly of the lamp or a focused light beam is available. The reflector has a larger-diameter opening facing a light projection window formed on one face of the valve and a bottom portion formed with a hole. An anode and a cathode are disposed in confrontation with each other in a space surrounded by the reflector. A trigger probe electrode intervenes between the anode and the cathode. A sparker electrode is disposed outside of the reflector and in the vicinity of the hole formed in the bottom portion thereof. By the provision of the reflector in the interior of the lamp, light of high radiation intensity is produced from the lamp without increasing the size of the lamp.

16 Claims, 2 Drawing Sheets

GASEOUS-DISCHARGE LAMP HAVING REFLECTOR IN INTERIOR THEREOF

BACKGROUND OF THE INVENTION

The present invention relates to gaseous-discharge lamps, and more particularly to such a lamp having a reflector in the interior thereof.

A conventional gaseous-discharge lamp has an arrangement as shown in FIGS. 1 and 2. As shown therein, a glass-made valve 2 of a circular cross-section serves as an enclosure in which an inert gas is hermetically confined. A light projection window 1 is formed on the top face of the enclosure from which light is emitted. A glass stem 3 is provided in the bottom of the valve 2, which includes a circular glass plate 3*a* and lead wires 4*a*, 4*b*, 4*c*, 4*d* passing through the glass plate 3*a* and extending to the interior of the valve 2. These lead wires are hermetically sealed and fixedly supported by beads 3*b*. The beads 3*b* are integrally formed in the glass plate 3*a* and arranged radially symmetrically in coaxial relation with the circular cross-section of valve 2. In the interior of the valve 2, a cathode 5, an anode 6, a trigger probe electrode 7 and a sparker electrode 8 are disposed which are connected to the lead wires 4*a*, 4*b*, 4*c* and 4*d*, respectively. The cathode 5 and the anode 6 are parallel to the light projection window 1 and are disposed in confrontation with each other with a space therebetween. The tip end of the trigger probe electrode 7 is placed between the cathode 5 and the anode 6. The sparker electrode 8 is disposed at a lower position with respect to the cathode 5, the anode 6, and the trigger probe electrode 7. The sparker electrode 8 is surrounded by a ceramic sleeve so that the tip end of the electrode 8 projects therefrom. The outer periphery of the ceramic sleeve is further surrounded by a nickel sleeve 15 which is connected to the cathode lead wire 4*a* with a lead wire 16.

In operation, by the application of a predetermined voltage between the cathode 5 and the anode 6 and first and second trigger voltages to the trigger probe electrode 7 and the sparker electrode 8, respectively, a discharge first occurs between the sparker electrode 8 and the nickel sleeve 15, thereby emitting ultraviolet radiation. The ultraviolet rays emitted toward the space between the cathode 5 and the anode 6, causes a gaseous arc discharge occurs between the trigger probe electrode 7 and the cathode 5. The main discharge which produces the light then occurs between the cathode 5 and the anode 6.

Such a lamp has been extensively used as a stroboscopic light source, liquid chromatographic light source, spectrophotometric light source, photo-exciting light source, etc., because the light emitted ranges from ultraviolet to visible or near infrared. When the lamp is so used, it is required that a high intensity light be stably emitted from the lamp.

However, the conventional lamp per se is incapable of complying with such a requirement. It has therefore been a conventional practice to use a focusing lens or a cup-shaped reflection mirror in conjunction with the lamp for increasing the intensity of the light. The lens is positioned ahead of the light projection window to focus the light therefrom. The reflection mirror is attached to the rear of the lamp to surround the same so that the light directed backwardly is reflected from the reflection mirror. The use of the lens is inconvenient in that only a particular size of the lens is usable. The use of the reflection mirror is not efficient because of the large diameter access hole needed for receiving the lamp.

SUMMARY OF THE INVENTION

It is therefore an object of the present invention to provide a gaseous-discharge lamp which emits light of a high intensity.

It is another object of the invention to provide a compact size gaseous-discharge lamp.

To achieve the above and other objects there is provided a gaseous-discharge lamp which comprises a valve defining an interior of the lamp in which a gaseous matter is confined; the valve having a light projection window. A reflector is disposed in the interior of the lamp, the reflector being of a cup shaped configuration having a circular cross-section whose diameter increases toward the light projection window. opening facing the light projection window and a bottom portion formed with a hole, an anode assembly having an anode surrounded by the reflector, the anode being applied with an anode voltage, and a cathode assembly having a cathode surrounded by the reflector and disposed in confrontation with the anode with a spacing therebetween. A first voltage being applied between the anode and the cathode. A trigger probe electrode assembly having a trigger probe electrode is disposed a second voltage lower than the first voltage being applied between the trigger probe electrode and the cathode. A sparker electrode assembly having a sparker electrode is disposed in spatial communication with the spacing through the hole formed in the bottom portion of the reflector. A third voltage being applied between the sparker electrode and the cathode causes a gaseous discharge between the trigger probe electrode and the cathode. The gaseous discharge further causes a main gaseous arc discharge in a position between the anode and the cathode.

The reflector has an inner surface whose cross-section is either a hyperbola or ellipse, and in the latter case, the anode and the cathode are disposed so that the position where the main gaseous discharge occurs is substantially in coincidence with a focal point of the ellipse. The reflector is made of a metal, preferably aluminum, and is electrically connected to the cathode.

By the provision of the reflector, the light of high radiation intensity is projected outwardly of the light projection window. Further, the metal-made reflector is held at the same potential as that of the cathode, the gaseous arc discharge is stabilized in terms of light radiation intensity.

The above and other objects, features and advantages of the present invention will become more apparent from the following description when taken in conjunction with the accompanying drawings in which preferred embodiments of the present invention are shown by way of illustrative examples.

DETAILED DESCRIPTION OF THE PREFERRED EMBODIMENTS

A gaseous-discharge lamp according to a preferred embodiment of the present invention will be described with reference to FIGS. 3 and 4. The gaseous-discharge lamp of the present invention is selectively operable in both a continuous mode and a repetitive pulse mode. When the lamp is operated as the continuous mode, the light of a high intensity is emitted continuously from the lamp whereas when operated as the repetitive pulse mode, flashes of light of a short duration and a high intensity are repetitively emitted therefrom.

Figure 1:
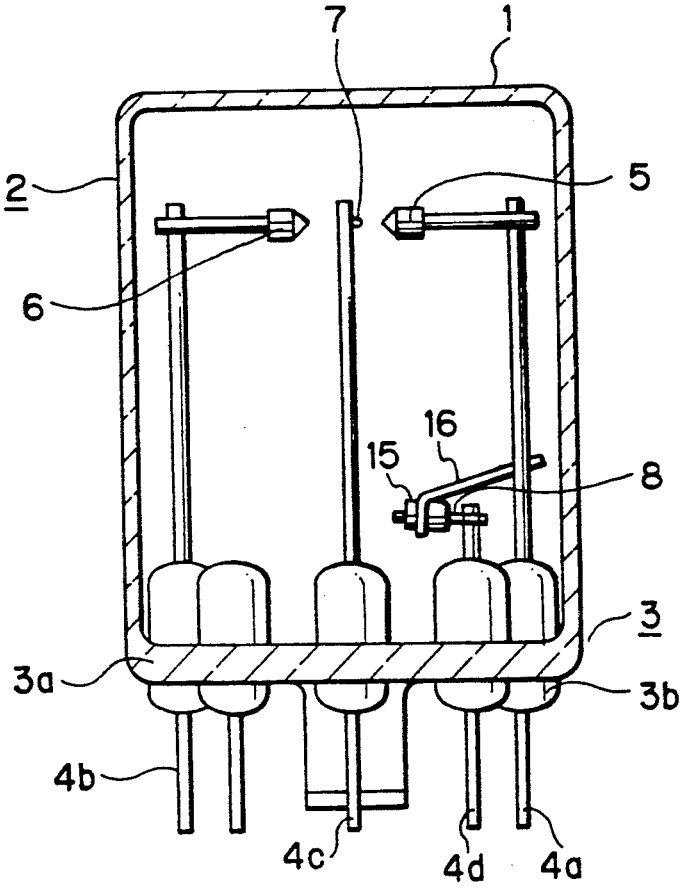
FIG. 1 PRIOR ART
FIG. 1 is a vertical cross-sectional view showing a conventional gaseous-discharge lamp.
Figure 2:
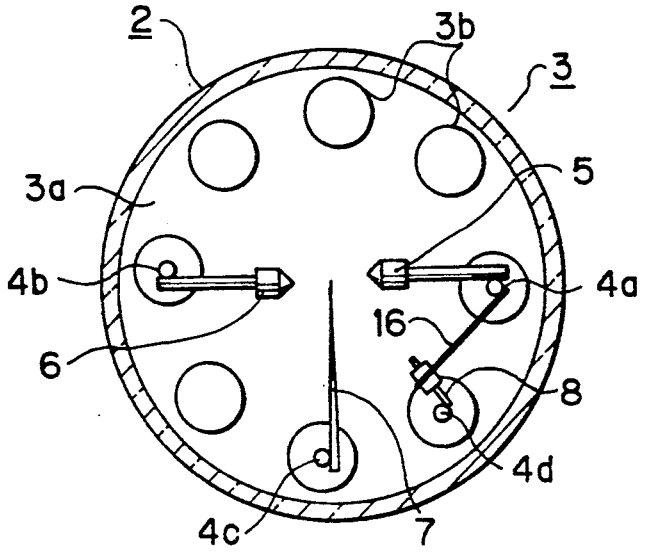
FIG. 2 PRIOR ART
FIG. 2 is a top plan view showing the conventional gaseous-discharge lamp.
Figure 3:
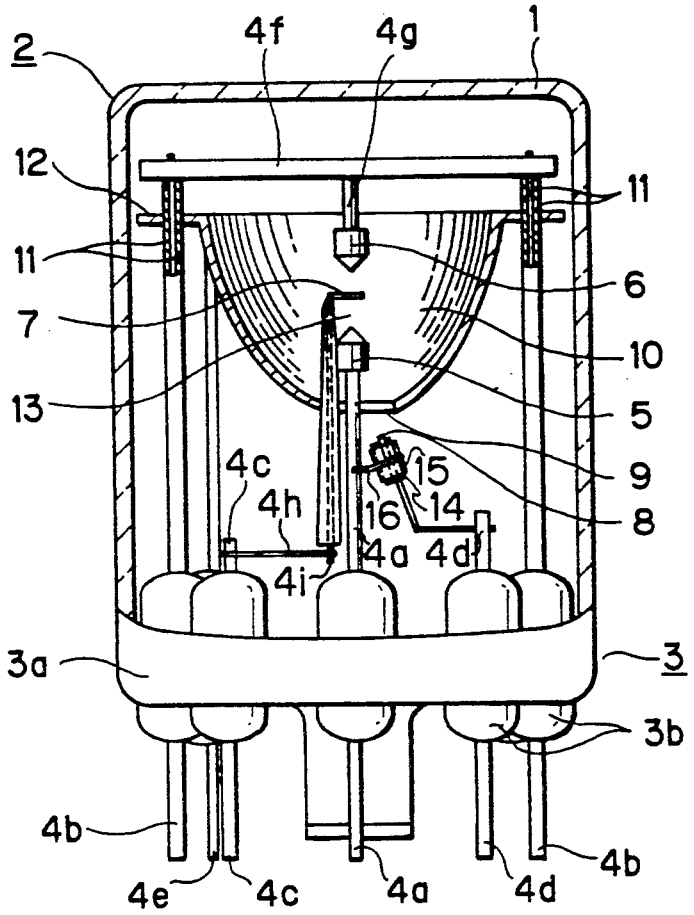
FIG. 3 is a vertical cross-sectional view showing a gaseous-discharge lamp according to an embodiment of the present invention.
Figure 4:
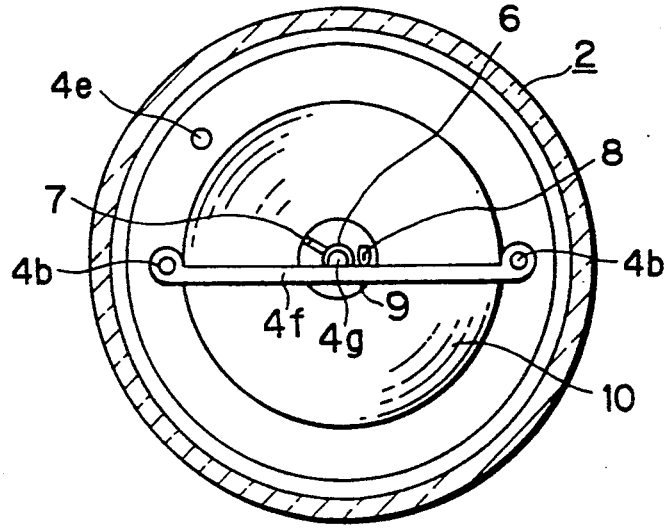
FIG. 4 is a top plan view showing the gaseous-discharge lamp according to the embodiment of the present invention.

Referring to FIGS. 3 and 4, the internal space of the gaseous-discharge lamp is defined by a glass-made enclosure or a valve 2. The valve 2 is of a circular cross-section and has a flat top face serving as a light projection window 1 out of which light is emitted and a glass stem 3 provided in the bottom. The glass stem 3 includes a circular glass plate 3*a*, and at least six lead wires passing through the glass plate 3*a*. The lead wires are hermetically and fixedly supported by beads 3*b* integrally formed in the glass plate 3*a*. A gaseous matter, typically inert gas, such as, xenon, argon, is hermetically confined within the valve 2.

A cathode lead wire 4*a* passes through the center of the glass plate 3*a* and extends into the internal space of the lamp. A pair of anode lead wires 4*b*, a trigger probe lead wire 4*c*, sparker lead wire 4*d* and a reflector lead wire 4*e* also pass therethrough from their respective positions arranged radially symmetrically with the outer profile of the glass plate 3*a*. The pair of the anode lead wires 4*b* are arranged in radially opposed positions and insulation tubes 11, 11 cover the anode lead wires 4*b*.

In the interior of the lamp, the anode lead wires 4*b* extend upwardly and a plate-like connector 4*f* bridges between the top ends of the anode lead wires 4*b*, to electrically connect the same. The connector 4*f* extends horizontally and the widthwise direction thereof is oriented in the longitudinal direction of the lamp. A lead wire 4*g* is connected to the mid-portion of the connector 4*f* to downwardly extend therefrom, and an anode 6 is connected to the lower end of the lead wire 4*g*. The cathode lead wire 4*a* extends upwardly into the interior of the lamp and a cathode 5 is connected to the upper end thereof so as to confront the anode 6 with a predetermined space therebetween. A trigger probe electrode 7 is disposed in the spacing between the anode 6 and the cathode 5. Trigger probe 7 is connected to the trigger probe lead wire 4*c* through a horizontally extending lead wire 4*h* and a vertically extending lead wire 4*i*.

A cup-shaped reflector 10 made of metal, such as aluminum, is disposed within the lamp to surround the anode 6, the cathode 5, and the trigger probe electrode 7. The reflector 10 has an increasing diameter toward the light projection window 1 and the larger-diameter open end thereof faces the projection window 1. A flange 12 is provided in the upper periphery of the reflector 10 and the anode lead wires 4*b*, 4*b* pass therethrough. By the insulation tubes 11, 11, the anode lead wires 4*b*, 4*b* and the metal-made reflector 10 are electrically insulated from each other. The reflector lead wire 4*e* is electrically connected to the flange 12.

The reflector 10 is symmetrical in its vertical cross-section and the configuration thereof depends upon its intended use. When the lamp is used in conjunction with a focusing lens disposed ahead of the projection window 1, the vertical cross-section is typically configured hyperbolic so that parallel light is emitted. When the lamp is used as a light source which produces a focused light, as in the case of applying light toward a cross-section of a bundle of optical fibers, it is configured to be elliptical in vertical cross-section. In this instance, the anode 6, the cathode 5, and the trigger probe electrode 7 are disposed so that the gaseous arc discharge is produced at a focal point of the ellipse.

The reflector 10 has a bottom portion formed with an access hole 9 through which the cathode lead wire 4*a* and the trigger probe lead wire 4*i* project upwardly. Below the access hole 9, and sparker electrode 8 is disposed which is connected to the sparker lead wire 4*d* through an extension lead. The sparker electrode 8 is surrounded by a ceramic sleeve 14 so that the tip end of the electrode 8 projects therefrom. The outer periphery of the ceramic sleeve 14 is further surrounded by a nickel sleeve 15 which is connected to the cathode lead wire 4*a* with a lead wire 16.

In operation, when a predetermined voltage is applied between the anode 6 and the cathode 5 and trigger voltages are applied to both the trigger probe electrode 7 and the sparker electrode 8 simultaneously, an arc first occurs between the sparker electrode 8 and the nickel sleeve 15, thereby emitting ultraviolet rays. When the ultraviolet rays are radiated toward the space between the cathode 5 and the anode 6 through the access hole 9, a gaseous arc discharge occurs between the trigger probe electrode 7 and the cathode 5, and then a main discharge occurs between the cathode 5 and the anode 6, whereby a three-dimensionally diverging light is produced. The rearwardly directing light is reflected from the reflector 10 and projected outwardly of the light projection window 1 as a whole. Collimating light is given if the reflector 10 is of a hyperbolic configuration in cross-section while focused light is given if the reflector 10 is of an elliptical vertical cross-section.

When operating the lamp in the repetitive pulse mode, pulsating voltages are applied to the anode 6, the trigger probe electrode 7, and the sparker electrode 8 simultaneously thus projecting a series of flashes of light of short duration out the light projection window 1. On the other hand, when operating the lamp in the continuous mode, a d.c. voltage is applied to the anode 6 and pulsating voltages are applied to the trigger probe electrode 7 and the sparker electrode 8, whereby light is continuously projected outwardly of the light projection window 1.

The reflector 10 is connected to the cathode 5 through the lead wire 4*e* to have the potential of the reflector 10 equal to that of the cathode 5, so that the gaseous arc discharge occurring between the anode 6 and the cathode 5 is stabilized and thus radiation light intensity is maintained substantially constant.

As described, the gaseous-discharge lamp according to the present invention incorporates the reflector in the interior of the valve and the sparker electrode is disposed outwardly of the reflector to be in spatial communication with the space where the main arc is taken place. Therefore, the rise-time of the lamp is extremely short when operated in both the continuous and the repetitive pulse modes. More specifically, when the lamp is operated in the continuous mode, the arc discharge occurs immediately after the application of the voltages. When, on the other hand, when operated in the repetitive pulse mode, flashes of light of a stable radiation intensity are emitted from the lamp.

Further, electromagnetic noise produced attendant to the arc is effectively interrupted by the provision of the reflector, and only the light can be derived from the lamp. In addition, because impulse waves produced by the arc discharge are not directly delivered to the valve, the glass stem, or the projection window, damage of the valve can be prevented and energy loss can be reduced.

What is claimed is:

1. A gaseous discharge lamp comprising:

a valve defining an interior of the lamp in which a gaseous matter is confined, said valve having a light projection window;

a reflector disposed in the interior of the lamp, said reflector having a cup-shaped configuration with a circular cross-section whose diameter increases toward the light projection window, said reflector having a larger-diameter opening facing the light projection window and a bottom portion formed with an access hole;

an anode assembly having an anode surrounded by said reflector, said anode having an anode voltage applied thereto;

a cathode assembly having a cathode surrounded by said reflector and disposed in confrontation with said anode with a space therebetween, a first voltage being applied between said anode and said cathode;

a trigger probe electrode assembly having a trigger probe electrode disposed in said space, a second voltage lower than the first voltage being applied between said trigger probe electrode and said cathode; and a sparker electrode assembly having a sparker electrode disposed outwardly of said reflector and in spatial communication with said space through the access hole formed in the bottom portion of said reflector, a third voltage being applied between said sparker electrode and said cathode for causing a gaseous discharge to occur between said trigger probe electrode and said cathode, said gaseous discharge causing a main gaseous discharge to occur in a position between said anode and said cathode, said sparker electrode assembly including an electric wire connected to said cathode, wherein ultraviolet rays are generated by an instantaneous gaseous discharge occurring between said sparker electrode and said electric wire when the trigger voltage is applied to said sparker electrode, said ultraviolet rays being irradiated toward said space between said anode and said cathode.

2. A gaseous-discharge lamp according to claim 1, wherein said reflector has an inner surface whose cross-section is a hyperbola.

3. A gaseous-discharge lamp according to claim 2, wherein said reflector is made of a metal.

4. A gaseous-discharge lamp according to claim 3, wherein said reflector is made of aluminum.

5. A gaseous-discharge lamp according to claim 4, wherein said reflector is electrically connected to said cathode.

6. A gaseous-discharge lamp according to claim 1, wherein said reflector has an inner surface whose cross-section is an ellipse.

7. A gaseous-discharge lamp according to claim 6, wherein said anode and said cathode are disposed so that the position where the main gaseous discharge occurs is substantially in coincidence with a focal point of the ellipse.

8. A gaseous-discharge lamp according to claim 7, wherein said reflector is made of a metal.

9. A gaseous-discharge lamp according to claim 8, wherein said reflector is made of aluminum.

10. A gaseous-discharge lamp according to claim 9, wherein said reflector is electrically connected to said cathode.

11. A gaseous-discharge lamp according to claim 1, wherein the gaseous matter is an inert gas.

12. A gaseous-discharge lamp according to claim 11, wherein said inert gas is xenon.

13. A gaseous-discharge lamp according to claim 11, wherein said inert gas is argon.

14. A gaseous-discharge lamp according to claim 1, wherein said anode, said trigger probe electrode, and said cathode are in alignment with one another along a line perpendicular to the light projection window.

15. A gaseous-discharge lamp according to claim 1, wherein the first, second, and third voltages are pulsating voltages applied at the same time, whereby flashes of light of short duration are projected outwardly of the light projection window.

16. A gaseous-discharge lamp according to claim 1, wherein the first voltage is a d.c. voltage and the second and third voltages are pulsating voltages applied at the same time, whereby light is continuously projected outwardly of the light projection window.

* * * * *